US006969196B2

(12) United States Patent
Woodham et al.

(10) Patent No.: US 6,969,196 B2
(45) Date of Patent: Nov. 29, 2005

(54) BAG HAVING RECLOSABLE SEAL AND ASSOCIATED METHODS

(75) Inventors: L. Roseann Woodham, Greenville, SC (US); Alfred A. McLellan, Inman, SC (US); Debra L. Sullivan, Pacolet Mills, SC (US); George Solomon, Spartansburg, SC (US)

(73) Assignee: Exopack-Technology, LLC, Spartanburg, SC (US)

( * ) Notice: Subject to any disclaimer, the term of this patent is extended or adjusted under 35 U.S.C. 154(b) by 76 days.

(21) Appl. No.: 10/383,929

(22) Filed: Mar. 7, 2003

(65) Prior Publication Data

US 2004/0175060 A1 Sep. 9, 2004

(51) Int. Cl.[7] ..... B65D 33/16
(52) U.S. Cl. ..... 383/89; 383/5
(58) Field of Search ..... 383/88–91, 82–83, 383/85, 5

(56) References Cited

U.S. PATENT DOCUMENTS 2,998,911 A 9/1961 Hahn et al.
3,081,930 A 3/1963 Owens
3,565,328 A 2/1971 Hudson
3,648,922 A 3/1972 Gebo
3,827,625 A 8/1974 Miller
4,441,613 A 4/1984 Hain et al.
4,460,091 A 7/1984 Hain et al.
4,480,752 A 11/1984 Jacobs
4,493,127 A 1/1985 Blanke, Jr. et al.
4,512,479 A 4/1985 Hain et al.
4,515,273 A 5/1985 Jacobson et al.
4,552,269 A 11/1985 Chang
4,567,987 A 2/1986 Lepisto et al.
4,584,217 A 4/1986 McClintock
4,610,651 A 9/1986 Jacobson et al.
4,616,470 A 10/1986 Nakamura
4,651,874 A 3/1987 Nakamura
4,653,250 A 3/1987 Nakamura
4,690,322 A 9/1987 Burns
4,739,879 A 4/1988 Nakamura
4,840,270 A 6/1989 Caputo et al.
4,911,563 A 3/1990 Ciani
4,946,289 A 8/1990 Bolling et al.
4,952,441 A 8/1990 Bose et al.
4,994,324 A 2/1991 Bose et al.
5,038,009 A 8/1991 Babbitt
5,048,718 A 9/1991 Nakamura
5,141,793 A 8/1992 Fontanilla (Continued)

OTHER PUBLICATIONS

US 6,068,403, 05/2000, Schneck (withdrawn)

*Primary Examiner*—Jes F. Pascua
(74) *Attorney, Agent, or Firm*—Bracewell & Giuliani LLP

(57) ABSTRACT

A bag having a reclosable sealer and methods of forming and using the same are provided. The bag, for example, can include a tube body having a plurality of laminated layers. A reclosable sealer can be attached to a first wall of the tube body. When the bag is in an open bag position, a first portion of the reclosable sealer is separated from a second portion of the reclosable sealer. When the reclosable sealer is in the closed seal position, the first portion of the reclosable sealer contacts the second portion of the reclosable sealer forming a seal to thereby allow the bag to be readily opened and closed. Peripheral portions of the bag can remain unsealed after initial opening when the reclosable sealer is in the closed seal position to indicate that initial opening has occurred and that tampering with the bag may have occurred.

19 Claims, 10 Drawing Sheets

U.S. PATENT DOCUMENTS 5,171,594 A 12/1992 Babbitt
5,345,399 A 9/1994 Collins
5,348,400 A * 9/1994 Haiss et al. ..... 383/210
5,427,849 A 6/1995 McClintock
5,482,376 A 1/1996 Moseley et al.
5,488,220 A 1/1996 Freerks et al.
5,529,396 A 6/1996 Pryor et al.
5,560,296 A 10/1996 Adams
5,582,342 A 12/1996 Jud
5,601,369 A 2/1997 Moseley et al.
5,616,385 A 4/1997 Rothrum et al.
5,728,037 A 3/1998 Pryor et al.
5,770,839 A 6/1998 Ruebush et al.
5,855,434 A 1/1999 Hagen
5,871,790 A 2/1999 Monier et al.
5,888,335 A 3/1999 Kobe et al.
6,019,713 A 2/2000 Scypinski et al.
6,046,443 A 4/2000 Ackerman et al.
6,048,100 A 4/2000 Thrall et al.
6,120,184 A 9/2000 Laurence et al.
6,148,100 A 11/2000 Anderson et al.
6,213,644 B1 4/2001 Henderson et al.
6,286,999 B1 9/2001 Cappel et al.
6,315,448 B1 11/2001 Thrall
6,325,541 B1 12/2001 Thrall
6,328,472 B1 12/2001 Laurence et al.
6,338,572 B1 1/2002 Schneck
6,374,461 B1 4/2002 Gober et al.
6,436,500 B1 8/2002 Yingst et al.
6,439,770 B2 8/2002 Catchman
6,478,465 B1 11/2002 Thrall
2001/0000461 A1 4/2001 Pfeiffer et al.

* cited by examiner

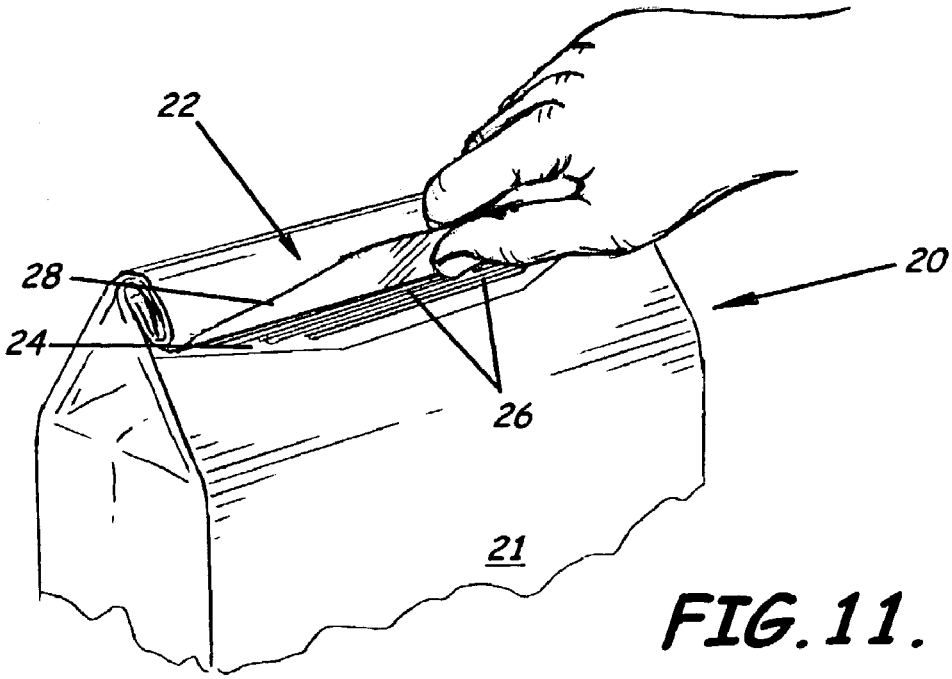
FIG. 11.
FIG. 12.
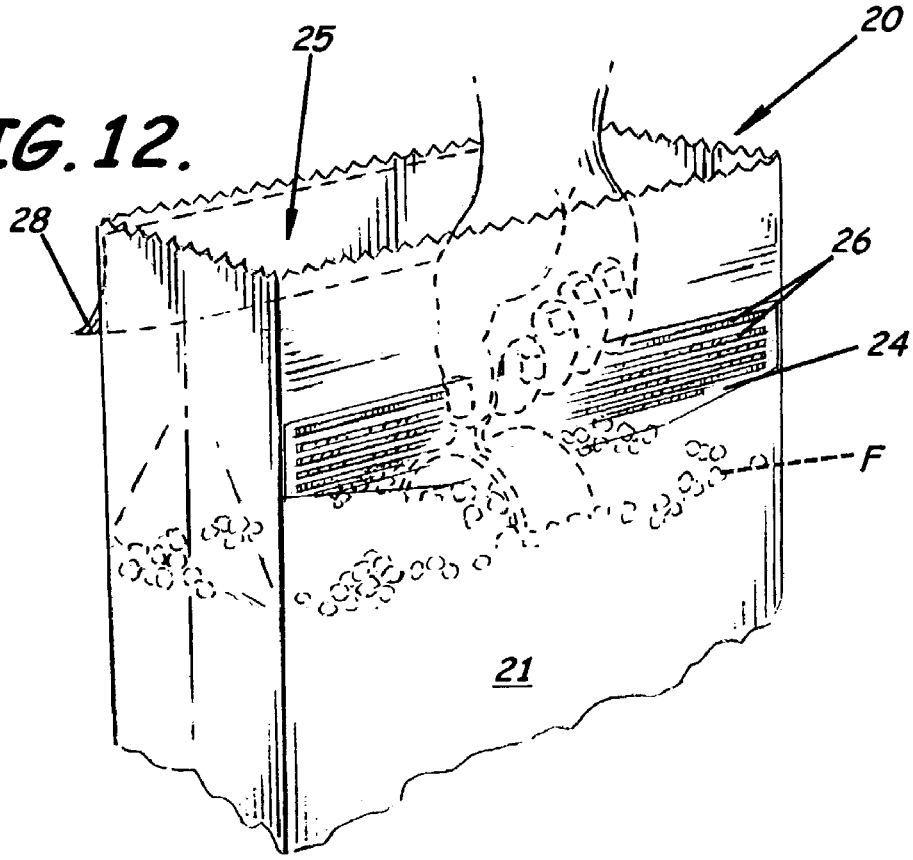

BAG HAVING RECLOSABLE SEAL AND ASSOCIATED METHODS

BACKGROUND OF THE INVENTION

1. Field of the Invention

The invention relates generally to the packaging industry. In more specific aspects, the invention relates to packaging and methods for forming packaging that have reclosable sealers associated with the package.

2. Description of the Related Art

Consumer products are typically packaged in end product packaging that traditionally has not allowed for repeated openings and closings of the packaging. Once the packaging is opened, the seal is broken and cannot be resealed even remotely as well as when originally obtained. Clips or bands generally have been required to reseal the packaging to maintain the freshness of the product contents within the packaging.

Being able to reseal the contents within the packaging is important for several other reasons besides for maintaining the freshness of the product contents contained within such packaging. Having a good seal on the packaging prevents the contents from spilling out; keeps environmental hazards, such as insects and moisture, from getting in the product; and protects the environment from the contents within the packaging. Besides being able to reseal packaging, other properties such as the ease of access to the materials within the packaging and tamper evidence to recognize or prevent the likelihood of tampering with the contents within the packaging can also be important.

An example of one such reclosable bag can found in U.S. Pat. Nos. 6,325,541 and 6,148,100, both titled "Resealable Closure for a Bag" by Thrall et al. These bags have a resealable closure, or tab, that allows for pouring of the contents from a spout or pour opening formed at the corner of the bag by the resealable closure. The pour opening only allows a portion of the bag top to be opened, which can make it difficult to gain full access to the contents of the bag, such as for scooping purposes.

Tabs have been used to provide easier opening of bags, such as illustrated in U.S. Pat. No. 6,338,572 titled "Easy Open Industrial Bag" by Schneck. Schneck describes the use of bags provided with a tab to enable users to open industrial bags more easily. Industrial bags are typically constructed with multiply walls, which make them very difficult to open without either cutting them or undoing stitching on sewn closed bags. Although the tab can allow for some easy opening of the industrial bags, due to apertures associated with originally the bags the tabs do not provide a manner in which to reclose the bags so that an adequate seal is maintained to retain the products securely within the bags.

Tampering with consumer goods has also become a problem throughout the years. Packaging producers have been developing better mechanisms to enable consumers to determine if the product within the packaging may have been subjected to some form of tampering or unwanted opening prior to customer purchase. Examples of bags with a tamper evident feature can be found in U.S. Pat. No. 6,286,999 by Catchman titled "Tamper-Evident Reclosable Bag" and U.S. Pat. No. 6,439,770 by Catchman titled "Reclosable Bags Having A Tamper-Evident Retaining Member Extending Through A Slider." These patents describe many types of devices that can be installed along with a zipper track for zippered bags to determine if tampering has occurred. Examples include a removable cardboard, paper, or plastic member covering or adjacent to a zipper slider in the closed position and then attached to the bag in some way. If the zipper is moved, the removable member will show signs of tampering. Applicants have recognized that the tamper-evident features in the Catchman patents require the use of some additional element that has to be damaged in order to show signs of tampering.

SUMMARY OF THE INVENTION

In view of the foregoing, an embodiment of the present invention advantageously provides end product packaging that can be preferably fillable from the top and includes a reclosable sealer that enables users to open and close the bag easily and reseal the bag securely without having to use extraneous clips or bands. An embodiment of the present invention also advantageously provides a wide opening for complete access to the products within the bag for activities such as scooping out the contents from the bag. In addition to the end product packaging, the present invention also advantageously provides methods of forming and using such bags. An embodiment of the present invention also advantageously provides a bag of tubular form having a tamper-evident feature that is integral with the bag. Further embodiments of the present invention advantageously provide user friendly bags capable of holding products of varying weights, that are strong and durable, that provide consumers with easy access to the products within the bags, and that have a dependable anti-tampering alert mechanism.

More particularly, a bag according to an embodiment of the present invention includes a tube body and a reclosable sealer. The tube body preferably can be a polymeric material, a paper material, a metal foil material, or combinations thereof. The tube body includes an open end and a closed end positioned substantially opposite the open end. The tube body also includes a first wall, e.g., a front wall or a back wall, which is positioned between the open end and the closed end, and a second wall, e.g., a back wall or a front wall, which is positioned to face opposite the first wall between the open and the closed end. The open end is substantially wide when in an open bag position to allow ready filling of the bag with contents and to allow ready access to the contents when positioned in the bag. The open end can be positioned to be closed so that end portions of the second wall abuttingly contact end portions of the first wall when in a closed bag position.

For simplification of describing the invention herein, the bag is described in terms of an open end, a closed end, a first wall, a second wall, and the like. These descriptions are merely illustrative of examples of a possible orientation of the bags of the present invention. Different orientations are possible and are to be considered within the scope of the present invention. For example, the references to the first wall and the second wall can be reversed as understood by those skilled in the art. As another example, the reclosable sealer can be added to a second wall of a bag. As another example, an open end or an upper end generally refer to the top of the bag, and a closed end or a lower end generally refer to the bottom of the bag. Other variations will be known to those skilled in the art and are to be considered within the scope of the present invention.

The reclosable sealer is connected to and extends outwardly from the first wall of the tube body adjacent the open end. When the reclosable sealer is in the open seal position, a first portion of the reclosable sealer is separated from a second portion of the reclosable sealer. When the reclosable sealer is in the closed seal position, the first portion of the reclosable sealer contacts the second portion of the reclosable sealer forming a seal to thereby allow the bag to be readily opened and closed.

The present invention advantageously provides a tamper indicator for the bag. The tamper indicator preferably includes a bonding material that extends to peripheral portions of the first wall. The reclosable sealer does not extend the entire width of the bag. Peripheral portions of the reclosable sealer remain unsealed after initial opening of the bag when the reclosable sealer is in the closed seal position. The unsealed portion on the edges of the reclosable sealer indicates that initial opening has occurred and indicates that tampering with the bag may have occurred. Alternatively, the reclosable sealer and adhesive material can extend the entire width of the bag. This embodiment also can provide an effective seal for the bag, and an alternate notice of potential tampering with the bag can be provided if desired. For example, perforations can be made on peripheral portions of the reclosable sealer. The perforations will separate the peripheral portions of the reclosable sealer from the remaining portion of the reclosable sealer once the reclosable sealer is opened using the reclosable sealer. The peripheral portions of the reclosable sealer can remain sealed after initial opening using the reclosable sealer even when the reclosable sealer is in the open seal position.

The first portion of the reclosable sealer can include a first adhesive layer, a first film layer, and a second adhesive layer. The first adhesive layer is preferably used to attach the reclosable sealer to the first wall of the tube body. The first film layer overlies and abuttingly contacts the first adhesive layer. The second adhesive layer overlies and contacts the first film layer. The second adhesive layer abuttingly contacts the second portion of the reclosable sealer when in the closed seal position.

The second portion of the reclosable sealer can include a second film layer, and a paper layer. The layers can be separate or can be constructed in a multiply configuration. The second adhesive layer and the second film layer of the first portion of the reclosable sealer abuttingly contact each other when the reclosable sealer is in the closed seal position. The second film layer can have a release agent applied to it. The paper layer overlies and abuttingly contacts the second film layer on a first side thereof. The paper layer can be a paper material or, alternatively, this layer can be a plastic layer, e.g., formed of a plastic material, instead of a paper layer. A second side of the paper layer adheres to a bonding material positioned on the outer surface of the second wall of the tube body to attach the reclosable sealer to the tube body.

According to another embodiment of the present invention, the bag can be altered, for example, to form a bag in which consumers can obtain, fill with their own contents, and then seal with a reclosable sealer to make a bag that can be resealed numerous times. The bag includes a tube body having an open end and an end opposing the open end. The end opposing the open end, which defines a closed end, can be adapted to be closed prior to filling with product or contents to operate as a bottom for the bag when the tube body is being filled through the open end with contents. The tube body has a first wall positioned between the open end and the closed end, and a second wall positioned to face opposite the first wall between the open and the closed end. The open end can also be adapted to be selectively positioned between an open bag position and a closed bag position by a user. The bag also preferably includes a reclosable sealer. The reclosable sealer is connected to and extends outwardly from the first wall of the tube body adjacent the open end. When the reclosable sealer is in the open seal position a first portion of the reclosable sealer is separated from a second portion of the reclosable sealer and a user has access to contents of the bag. When the reclosable sealer is in the closed seal position the first portion of the reclosable sealer contacts the second portion of the reclosable sealer and contents cannot be readily removed from the bag. A bonding material can be positioned on an outer surface of the reclosable sealer. In this embodiment, a disposable layer is positioned to overly, abuttingly contact, and protect the bonding material until the reclosable sealer is attached to the second wall of the tube body by the user, once the user has filled the bag with his or her own contents.

In addition to the bags with the reclosable sealer, the present invention also advantageously provides methods of forming and using a bag having a reclosable sealer associated therewith. A method of forming the bag includes laminating a plurality of layers of material. The plurality of layers can preferably be selected from a polymeric material, a metal foil material, a paper material, and combinations thereof. Once the layers of material are laminated, the layers are formed into a tube body. The tube body preferably has an open end and a closed end positioned substantially opposite the open end. The tube body is formed from a plurality of laminated layers so that at least one layer of laminated material defines an inner surface of the tube body and at least one layer of laminated material defines an outer surface of the tube body. The tube body preferably has a first wall positioned between the open end and the closed end and a second wall positioned to face opposite the first wall. Once the tube body is formed, a reclosable sealer is attached to the first wall of the tube body adjacent the open end. When the reclosable sealer is in an open seal position a first portion of the reclosable sealer is separated from a second portion of the reclosable sealer. When the reclosable sealer is in the closed seal position the first portion of the reclosable sealer contacts the second portion of the reclosable sealer to thereby allow the bag to be readily opened and closed. When in the open position, the bags are then filled with an end user product. Once the bags are filled, a bonding material is positioned on an outer surface of the second wall of the tube body adjacent the open end of the bag. The first and second walls are folded until the bonding material contacts and substantially adheres to the reclosable sealer thereby forming a bond.

The method of forming the bag with a reclosable sealer, for example, can be altered by supplying layers of materials that are already laminated according to the present invention. If the materials are already laminated, then the tube body can be formed without having to laminate the materials.

As another embodiment of the present invention, the method of forming the bag can be modified to include forming a bag that consumers can purchase to fill with their own products. In this embodiment, the reclosable sealer is attached to the first wall of the tube body adjacent the open end and a bonding material is positioned on an outer surface of the reclosable sealer. A disposable layer is positioned to overly, abuttingly contact, and protect the bonding material until the reclosable sealer is attached to the second wall of the tube body.

Methods of using the bag are also provided as another embodiment of the present invention. In one embodiment, a second portion of a reclosable sealer is lifted to separate the second portion of the reclosable sealer from the first portion of the reclosable sealer. Once the first and second portions are separated, the first wall and the second wall are unfolded and then separated. Once the walls are separated, users will have a wide access point to the contents of the bag. This wide access point will enable users to be able to perform such activities as scooping the contents out of the bag or filling the bag with contents.

Another method of using the bag is also advantageously provided. In this embodiment, a first wall and a second wall of a bag are separated to define an open bag position. The open bag position provides a substantially wide-opening access to contents of the bag. The bag advantageously has a reclosable sealer attached to the first wall adjacent an open end so that when the reclosable sealer is in an open seal position a first portion of the reclosable sealer is separated from a second portion of the reclosable sealer. When the reclosable sealer is in a closed seal position, the first portion of the reclosable sealer contacts the second portion of the reclosable sealer to thereby allow the bag to be readily opened and closed. The bag is then filled with contents through the substantially wide-opening access and into the bag when in the open bag position. A protective disposable layer that is positioned on a bonding material positioned on an outer surface of the second portion of the reclosable sealer is removed once the bag has been filled with contents. Once the bag is filled, the first and second walls are folded until the bonding material contacts and substantially bonds to the second wall of the bag thereby attaching the reclosable sealer to the bag.

Yet another method of using a bag is advantageously provided. In this embodiment, a first wall and a second wall of a bag are separated to define an open bag position. The open bag position provides a substantially wide-opening access to contents of the bag. The bag preferably has a reclosable sealer attached to the first wall adjacent an open end. When the reclosable sealer is in an open seal position, a first portion of the reclosable sealer is separated from a second portion of the reclosable sealer. When the reclosable sealer is in a closed seal position, the first portion of the reclosable sealer contacts the second portion of the reclosable sealer to thereby allow the bag to be readily opened and closed. The bag can be filled with contents through the substantially wide-opening access of the bag when in the open bag position. Once the bag is filled, a protective disposable layer positioned on a bonding material positioned on an outer surface of the second wall is removed. The first and second walls are folded until the bonding material contacts and substantially bonds to the second portion of the reclosable sealer thereby attaching the reclosable sealer to the second wall.

It is envisioned that the resealable packaging of the present invention can be used for any type of product that requires easy access to the contents within and the ability to repeatedly open and close the bag without the need for extraneous objects, such as clips or pins. Such product uses, for example, include bags for various food items, pet food, charcoal, building materials, seed, lawn and garden supplies, and other uses as will be known to one skilled in the art and are to be considered within the scope of this invention.

BRIEF DESCRIPTION OF THE DRAWINGS

So that the manner in which the features and advantages of the invention, as well as others which will become apparent, may be understood in more detail, more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

FIG. 11 is a fragmentary perspective view of a hand of a user lifting a top flap of a reclosable sealer to open the bag according to an embodiment of the present invention;

FIG. 12 is a fragmentary perspective view of a hand of a user scooping product out of an opened bag having a reclosable sealer in an open seal position according to an embodiment of the present invention;

DETAILED DESCRIPTION

Figure 1:
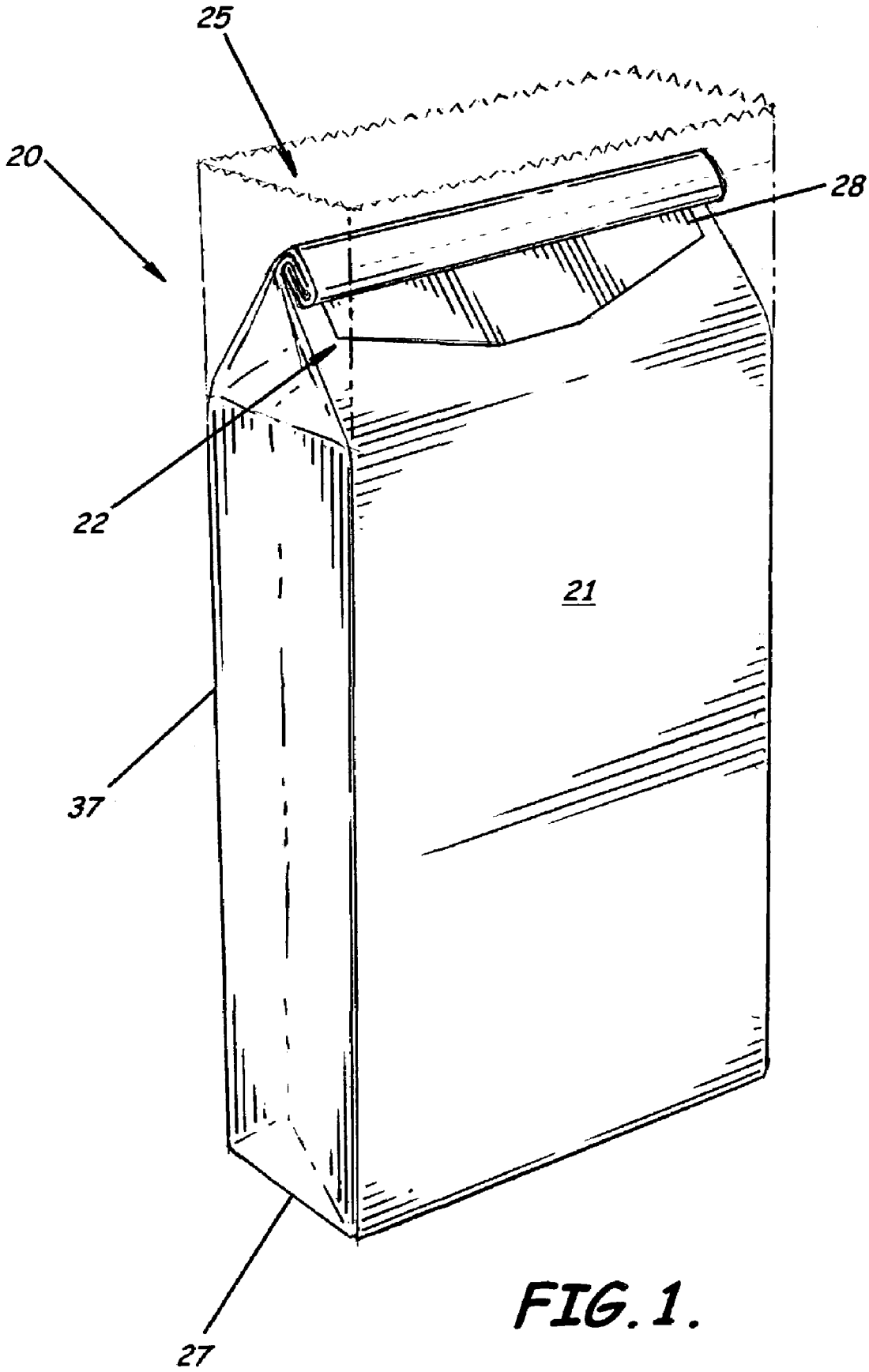
FIG. 1 is a perspective view of a bag having a reclosable sealer according to an embodiment of the present invention.

The present invention will now be described more fully hereinafter with reference to the accompanying drawings that illustrate preferred embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. The prime notation, if used, indicates similar elements in alternative embodiments.

As illustrated in FIGS. 1–14, an embodiment of the present invention advantageously provides a bag 20 of tubular form. The bag 20 includes a tube body, and a reclosable sealer 22. The tube body preferably includes a first wall 21, e.g., a front wall or a back wall, a second wall 37, e.g., a back wall or a front wall, an open end 25, and a closed end 27. The first wall 21 is positioned between the open end 25 and the closed end 27. The second wall 37 is positioned to face opposite the first wall 21 between the open and the closed ends 25, 27.

Figure 7:
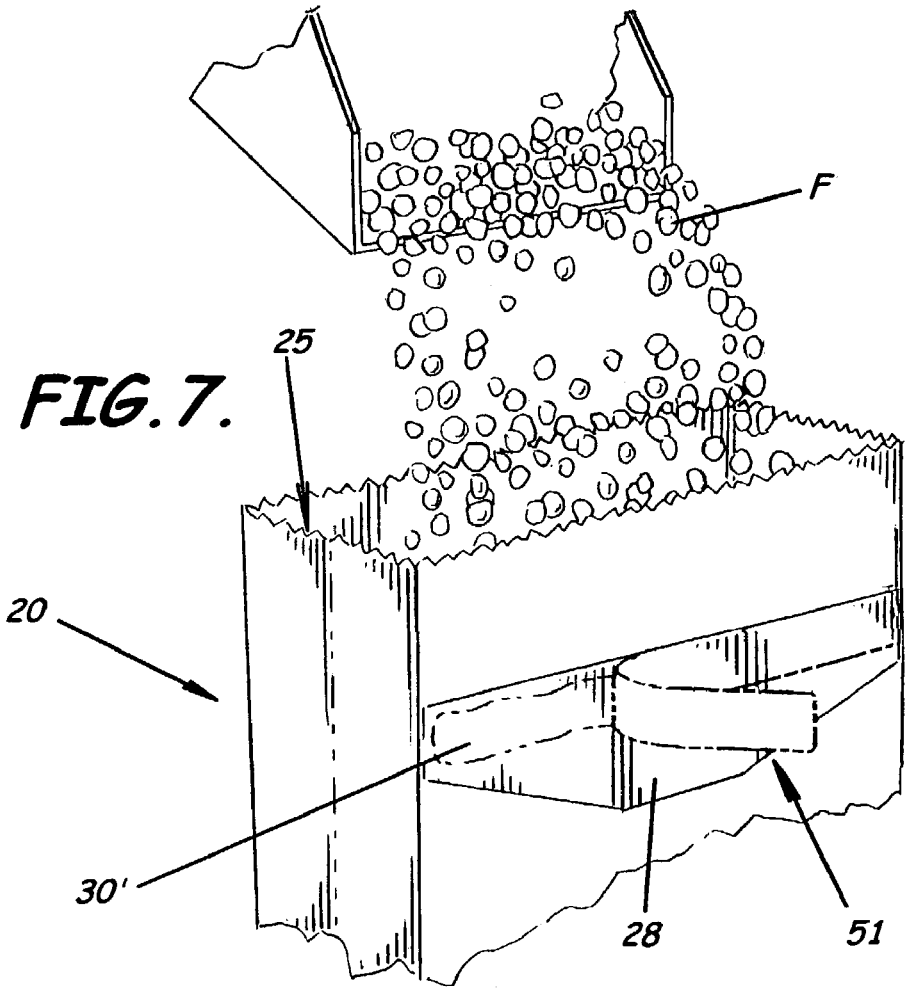
FIG. 7 is a fragmentary perspective view of a bag having a reclosable sealer attached to a first wall of the bag being filled with product according to an embodiment of the present invention.
Figure 8:
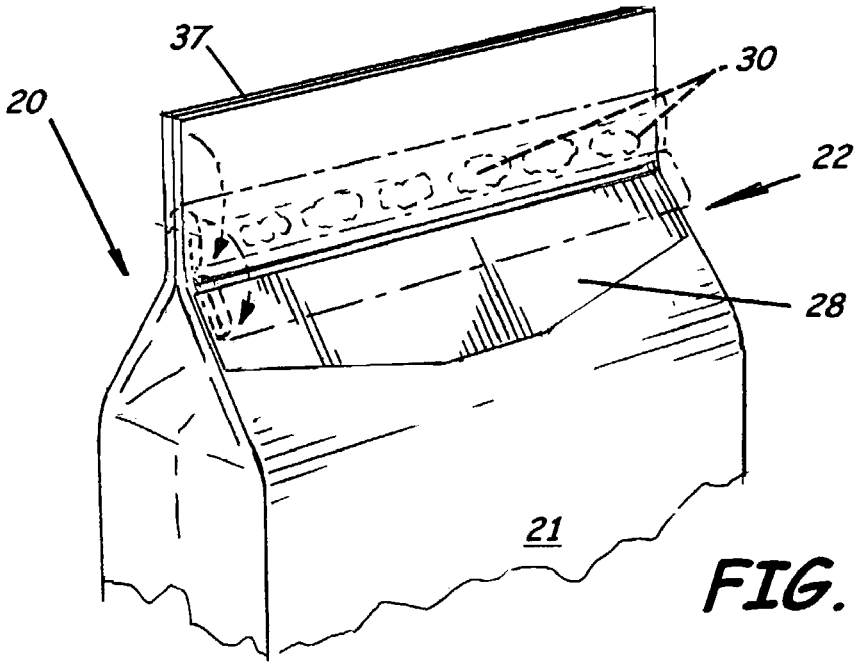
FIG. 8 is a front fragmentary front perspective view of a bag having a reclosable sealer being folded to attach an adhesive material to the reclosable sealer according to an embodiment of the present invention.
Figure 9:
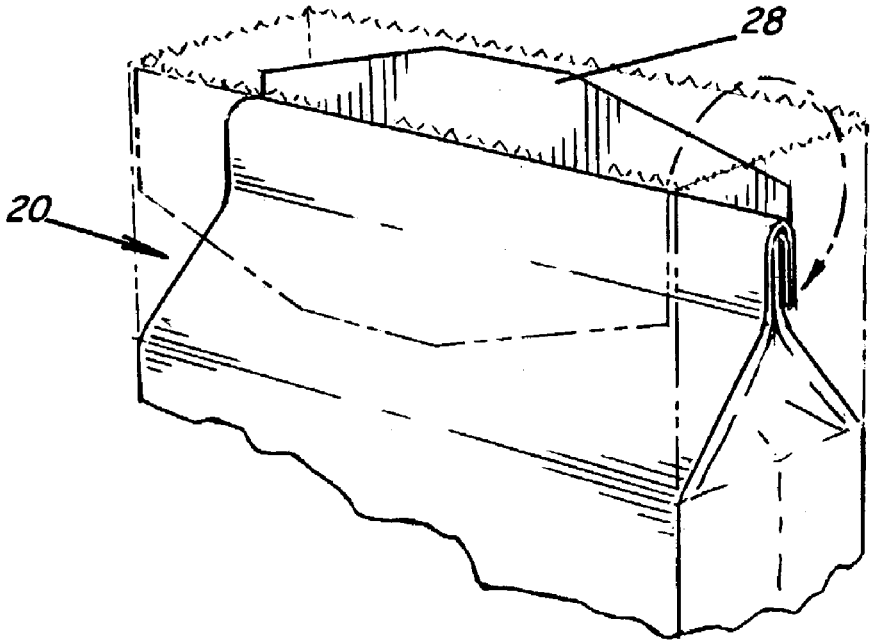
FIG. 9 is a back fragmentary rear perspective view of a bag having a reclosable sealer being folded to attach an adhesive material to the reclosable sealer according to an embodiment of the present invention.

In embodiments of the present invention, the tube body preferably has at least one layer of a material selected from a polymeric material, a paper material, and a metal foil material. The open end 25 is substantially wide when in an open bag position to allow ready filling of the bag 20 with contents and to allow ready access to the contents when positioned in the bag 20, as shown in FIGS. 1 and 7. Providing such access to the contents allows users to perform such activities as scooping the contents from the bag 20, as illustrated in FIG. 12. This feature is particularly advantageous for large bags that may be too large to pick up and pour. The open end 25 can be positioned so that end portions of the second wall 37 abuttingly contact end portions of the first wall 21 when in a closed bag position.

Figure 4:
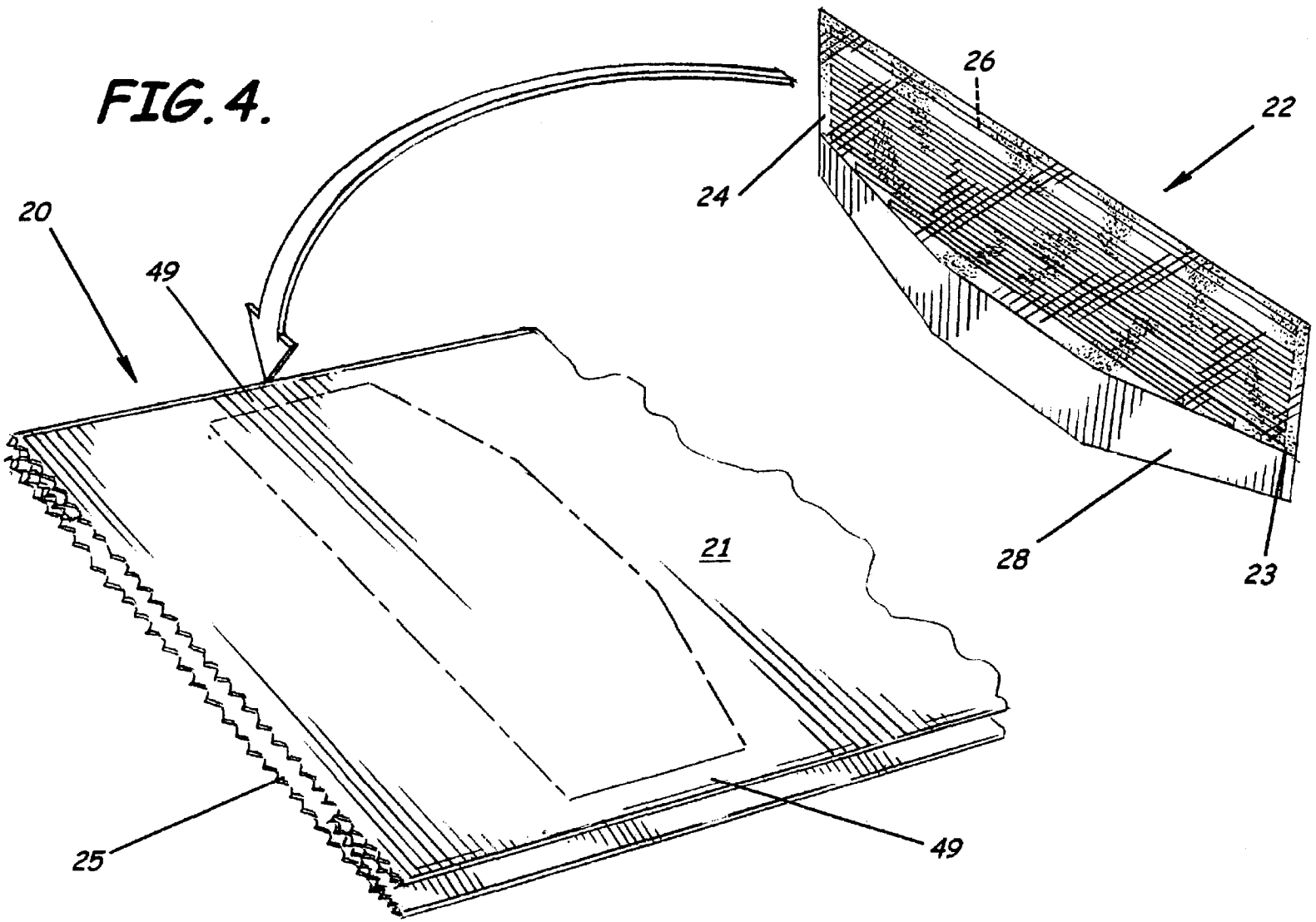
FIG. 4 is a fragmentary perspective view of a reclosable sealer being applied to a tube body to form a bag with a reclosable sealer according to an embodiment of the present invention.
Figure 6A:
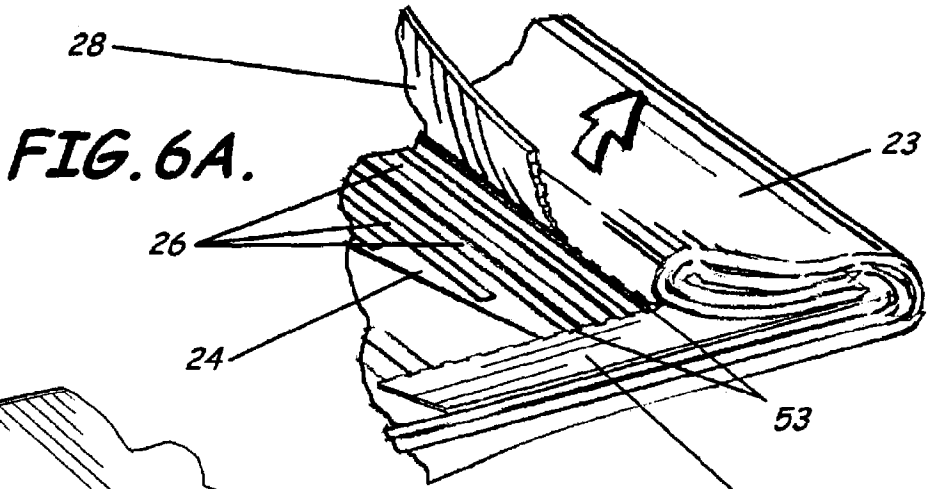
FIG. 6A is an enlarged fragmentary perspective view of a reclosable sealer of a bag having an alternate tamper evident feature being opened according to an embodiment of the present invention.
Figure 6:
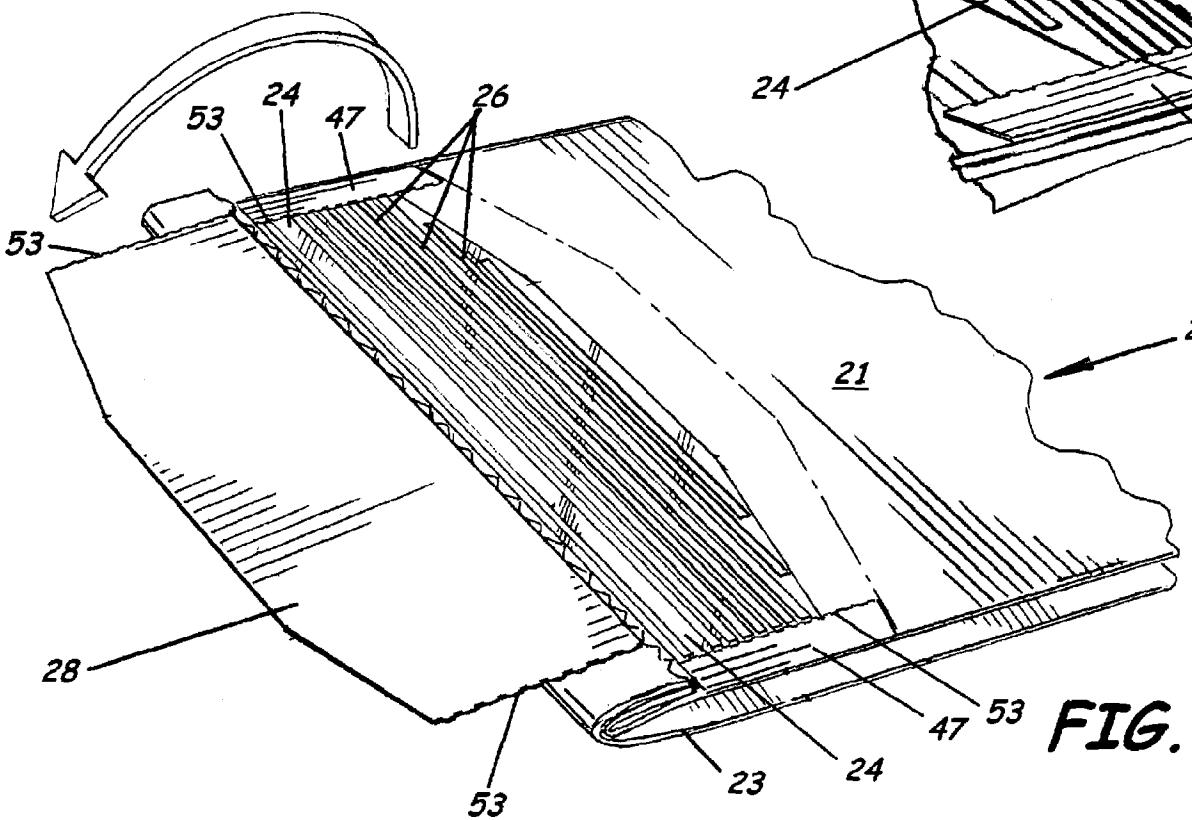
FIG. 6 is a fragmentary perspective view of bag having a reclosable sealer and an alternate tamper evident feature being opened in accordance with an embodiment of the present invention.

The reclosable sealer 22 is positioned on an outer surface of the first wall 21 of the tube body adjacent the open end 25, as shown in FIG. 4. As illustrated in FIG. 6, the reclosable sealer 22 is connected to and extends outwardly from the second wall 37 of the tube body adjacent the open end 25.

Figure 2:
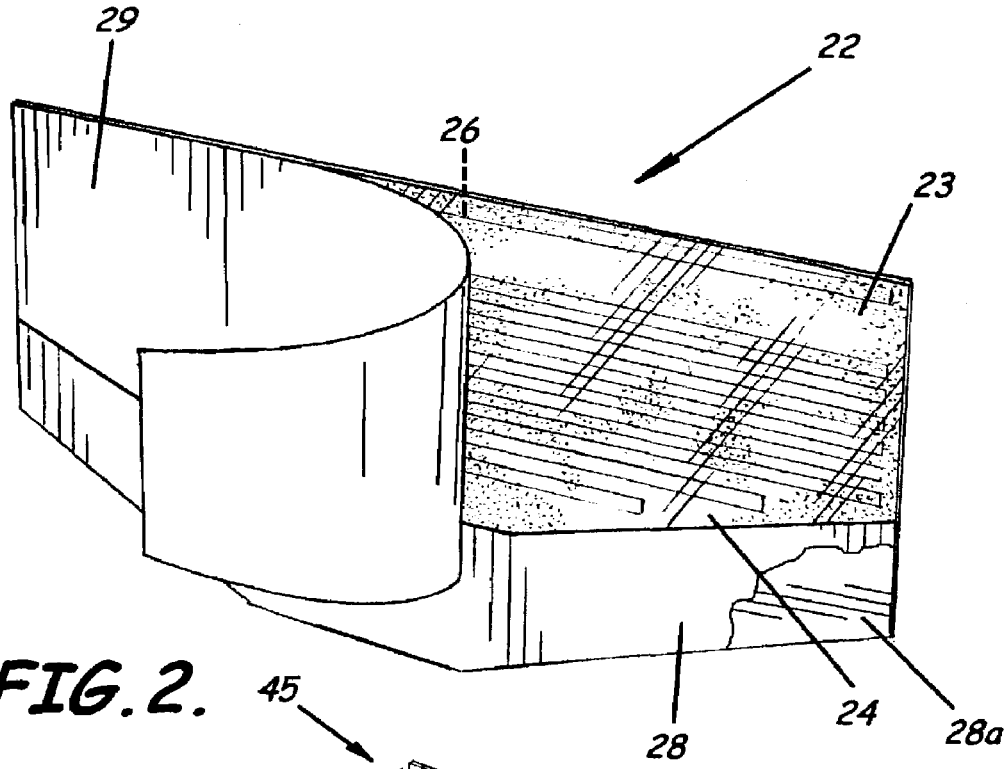
FIG. 2 is an enlarged perspective view of a reclosable sealer of a bag according to an embodiment of the present invention.
Figure 3:
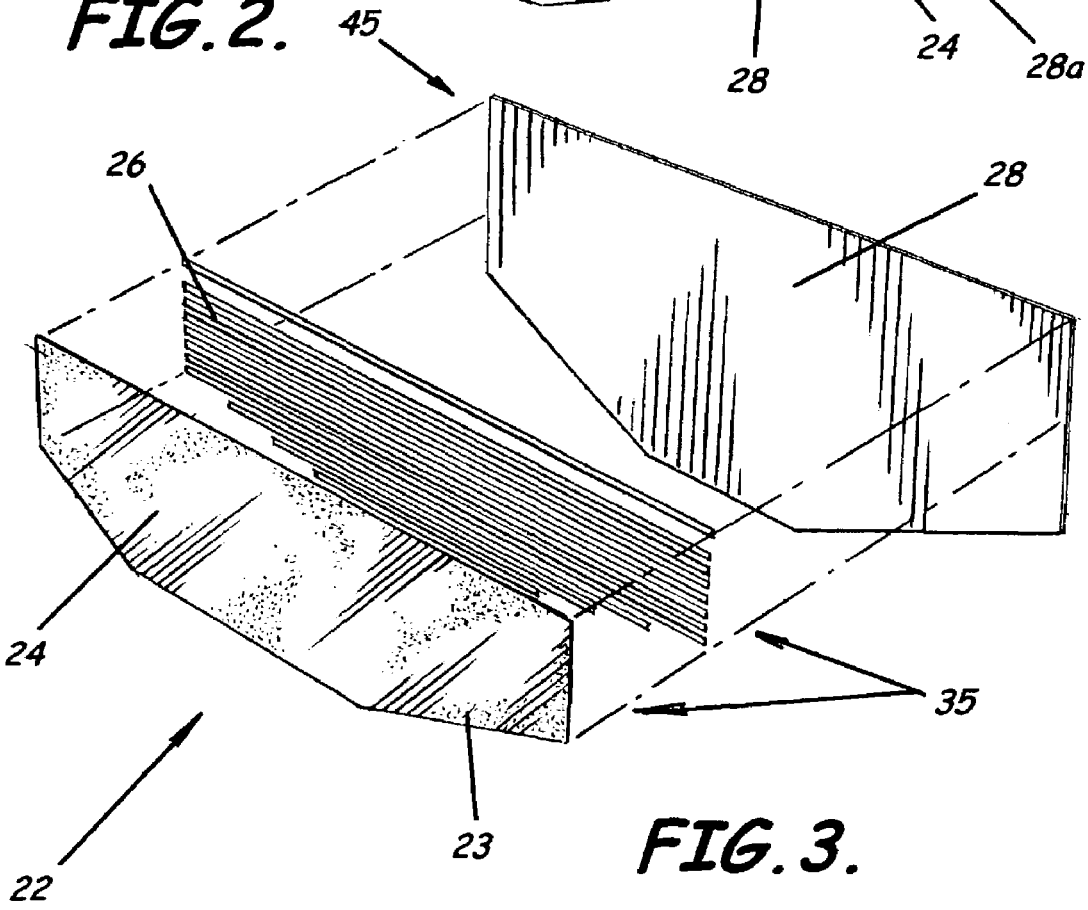
FIG. 3 is an exploded view of a reclosable sealer of a bag according to an embodiment of the present invention.

The reclosable sealer 22 includes a first portion 35 and a second portion 45. The first portion 35 and the second portion 45 can be preassembled with both portions within one unit, as shown in FIG. 2. Suitable preassembled cards for this application method, for example, have been developed by LithoFlex Corporation of St. Louis, Mo. A disposable layer 29 can be used to protect a first adhesive layer 24 of the first portion 35 of the reclosable sealer 22 that is used to attach the reclosable sealer 22 to the bag 20.

Figure 10:
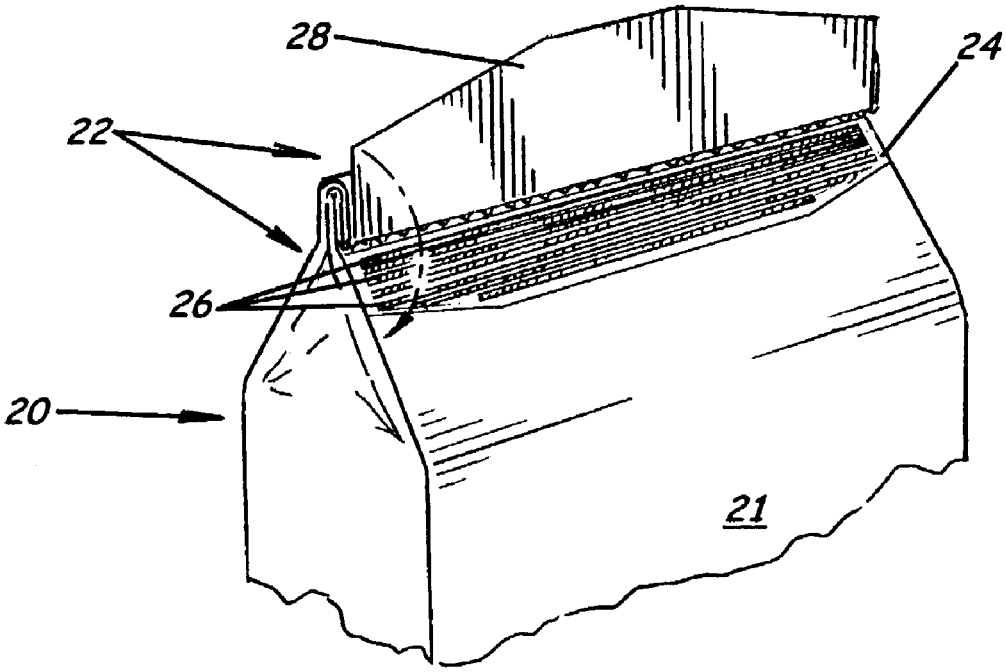
FIG. 10 is a fragmentary perspective view of a bag having a reclosable sealer showing a top flap of a reclosable sealer being pressed into a bottom flap of the reclosable sealer to reseal the reclosable sealer according to an embodiment of the present invention.
Figure 13:
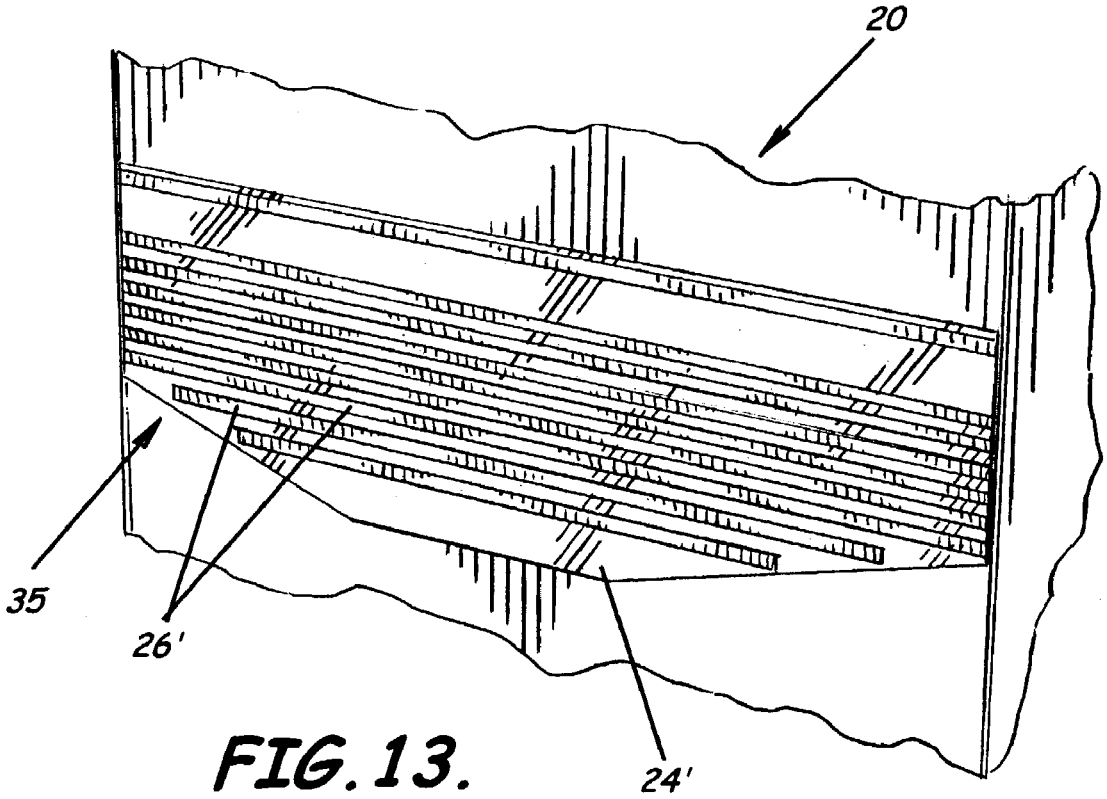
FIG. 13 is a fragmentary perspective view of a bottom flap of a reclosable sealer including at least one adhesive layer according to an embodiment of the present invention.

In embodiments of the present invention, when the reclosable sealer 22 is in the open seal position, the first portion 35 of the reclosable sealer 22 is separated from the second portion 45 of the reclosable sealer 22. When the reclosable sealer 22 is in the closed seal position, the first portion 35 of the reclosable sealer 22 contacts the second portion 45 of the reclosable sealer 22 forming a seal to thereby allow the bag 20 to be readily opened and closed. In one embodiment of the present invention, the reclosable sealer 22 does not extend the entire width of the bag 20. Peripheral portions of the reclosable sealer 22 remain unsealed after initial opening of the bag 20 even when the reclosable sealer 22 is in the closed seal position, as shown in FIG. 10. The unsealed portion on the edges of the reclosable sealer 22 indicate that initial opening has occurred and indicate that tampering with the bag 20 may have occurred.

The first portion 35 of the reclosable sealer 22 preferably includes a first bag flange member and the second portion 45 of the reclosable sealer 22 preferably includes a second bag flange member. The second portion 45 of the reclosable sealer 22 preferably overlies and substantially contacts the first portion 35 of the reclosable sealer 22 when in the closed seal position.

In embodiments of the present invention, the first portion 35 of the reclosable sealer 22 can include the first adhesive layer 24, a first film layer 23, and a second adhesive layer 26. The first adhesive layer 24 is preferably used to attach the reclosable sealer 22 to the first wall 21 of the tube body. The first film layer 23 overlies and abuttingly contacts the first adhesive layer 24. The first film layer 23 can be a polyester or other polymeric film. Other suitable materials can be used as a first film layer 23 and will be known to those skilled in the art. The first portion 35 of the reclosable sealer 22 can include separate layers or can have a multiply configuration.

In embodiments of the present invention, the second portion 45 of the reclosable sealer 22 can include a second film layer 28 that can be coated with a release agent, e.g., silicone, and a paper layer **28*a*. The layers can be separate or can be constructed in a multiply configuration. The second film layer 28 is positioned to abuttingly contact the second adhesive layer 26 of the first portion 35 of the reclosable sealer 22 when in the closed seal position. The paper layer 28*a* abuttingly contacts the second film layer 28 on a first side. A second side of the paper layer 28 adheres to a bonding material 30 positioned on the outer surface of the second wall 37 of the tube body to attach the second portion 45 of the reclosable sealer 22 to the tube body. The paper layer 28*a* is preferably constructed of a paper material. Use of paper enables packaging producers to print on the paper layer 28*a* and allows the paper layer 28*a* to blend in more with the overall appearance of the bag 20. The paper layer 28*a* can also be laminated with or constructed of a plastic material that can be transparent or overcoated, e.g., with a lacquer material, which will also help the paper layer 28*a* blend in more with the overall appearance of the bag 20**.

The second adhesive layer 26 can include a continuous pattern of adhesive material positioned in a preselected region of the outer surface of the first film layer 23. The continuous pattern can include a plurality of spaced apart lines of adhesive material positioned on the outer surface of the first film layer 23. A solid coating of adhesive material is also believed to be an effective alternative for the continuous pattern of adhesive material.

The first wall 21 and the second wall 37 of the tube body each can have a first end and a second end. The respective first ends of the first and second walls 21, 37 define the open end 25 of the tube body. The respective second ends of the first and second walls 21, 37 define the closed end 27 of the tube body. Each of the first ends of the first and second walls 21, 37 are substantially linear and substantially perpendicular to side peripheries of the respective first and second walls 21, 37.

The first end portions of the first and second walls 21, 37 can be folded when in the closed bag position. The reclosable sealer 22 can extend substantially the entire lateral extent of the second wall 37 of the tube body adjacent the open end.

Figure 5A:
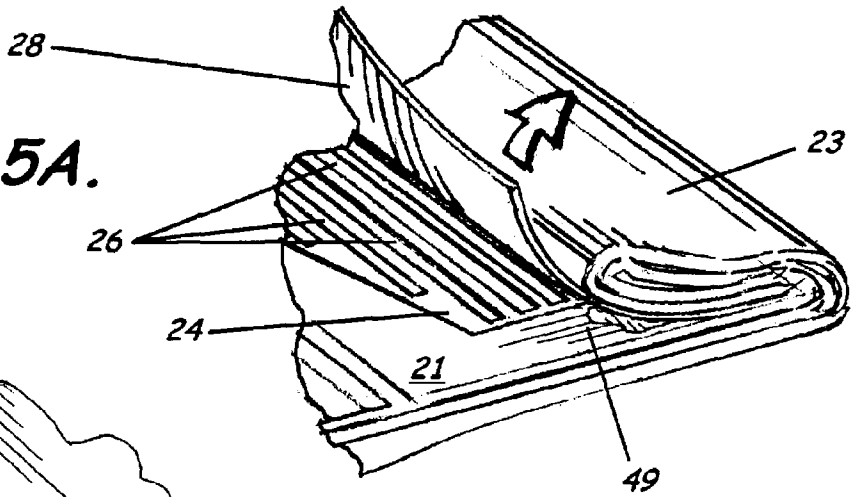
FIG. 5A is an enlarged fragmentary perspective view of a reclosable sealer of a bag having a tamper evident feature being opened according to an embodiment of the present invention.
Figure 5:
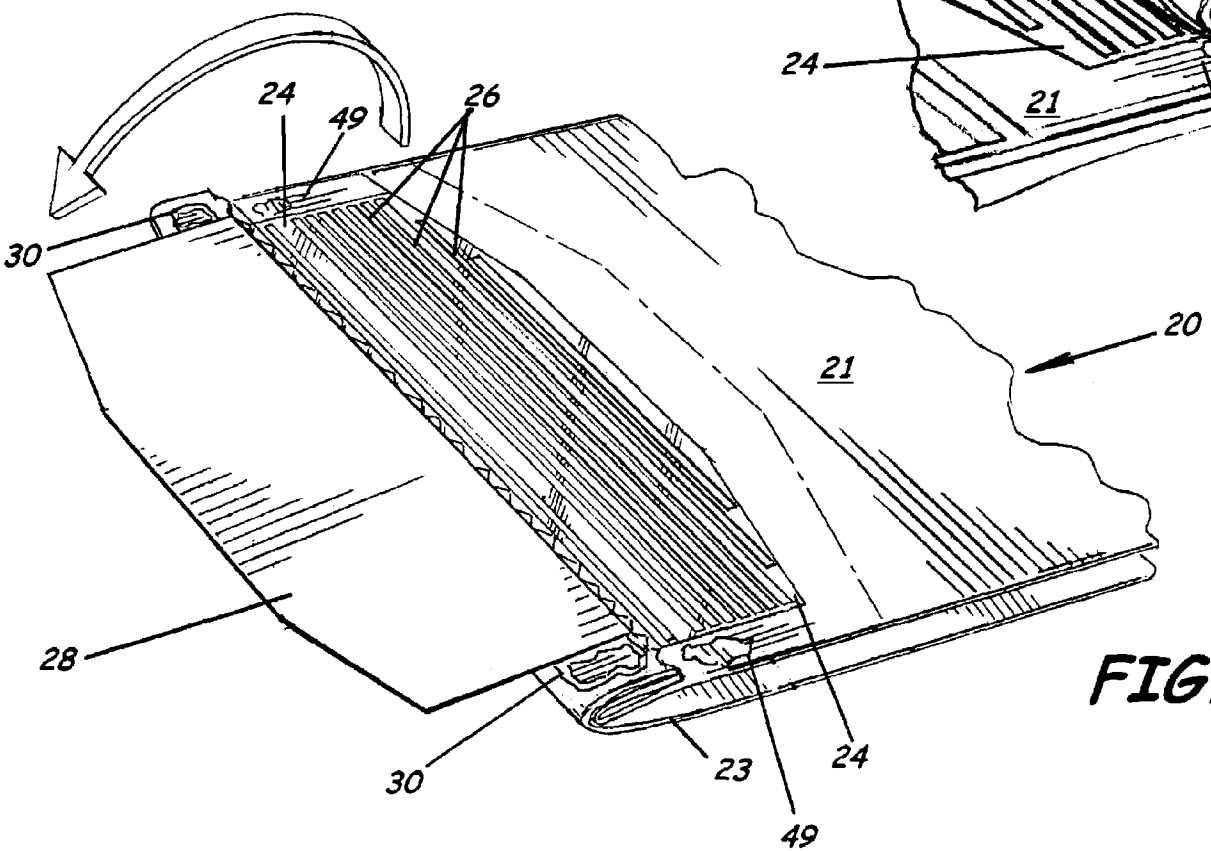
FIG. 5 is a fragmentary perspective view of bag having a reclosable sealer and a tamper evident feature being opened in accordance with an embodiment of the present invention.
Figure 14:
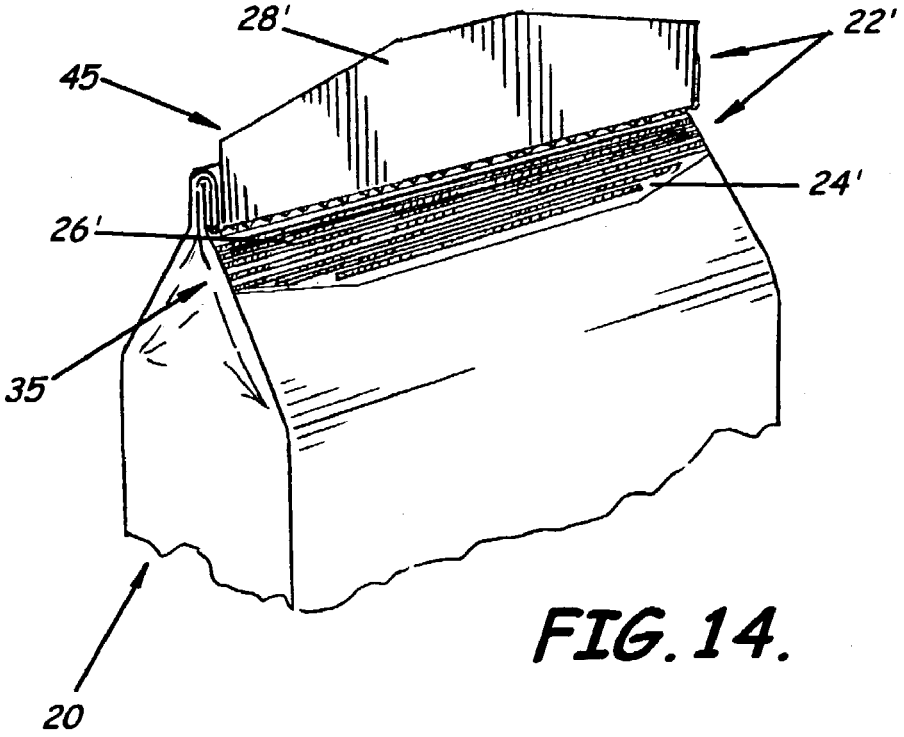
FIG. 14 is a fragmentary perspective view of a bag having a reclosable sealer with an adhesive layer extending the entire width of the bag according to another embodiment of the present invention.

An embodiment of the present invention advantageously provides a bag having a tamper evidence indicator. The tamper evidence indicator preferably includes a bonding material 30 that extends to peripheral portions of the first wall 21 so that peripheral portions 49 of the bag 20, such as peripheral portions 49 of the second wall 37, can remain unsealed after initial opening using the reclosable sealer 22 even when the reclosable sealer 22 is in the closed seal position, as shown in FIGS. 5 and 5A. The reclosable sealer 22 does not extend the entire width of the bag 20. The peripheral portions 49 can provide an indication that initial opening of the bag 20 has occurred and that tampering with the bag 20 may have occurred. Alternatively, the reclosable sealer 22' and adhesive material 26' can extend the entire width of the bag 20 as shown in FIG. 14. This embodiment is equally effective for providing a seal for the bag 20, and an alternate notice of potential tampering with the bag 22 can be provided if desired. For example, perforations 53 can be made on peripheral portions 47 of the reclosable sealer 22, as shown in FIGS. 6 and 6A. The perforations 53 will separate the peripheral portions 47 of the reclosable sealer 22 from the remaining portion of the reclosable sealer 22 once the reclosable sealer 22 is opened using the reclosable sealer 22. The peripheral portions 47 of the reclosable sealer 22 can remain sealed after initial opening using the reclosable sealer 22 even when the reclosable sealer 22 is in the open seal position.

The second portion 45 of the reclosable sealer 22 preferably includes regions thereof extending toward the closed end of the tube body when in the closed seal position devoid of contact with the second adhesive layer 26 for easy grasping, as shown in FIG. 11. The reclosable sealer 22 preferably includes an adhesive release agent as understood by those skilled in the art positioned on the second film layer 28 to enhance ready release of second portion 45 of the reclosable sealer 22 from the second adhesive layer 26 of the first portion 35 when an upright bag 20 is in a closed seal position by manual upward pressure on the reclosable sealer 22.

According to another embodiment of the present invention, the bag 20 can be altered, for example, to form a bag 20 with a reclosable sealer 22 attached thereto in which consumers can obtain, fill with their own contents, and then seal with the reclosable sealer 22 that can be resealed numerous times. The bag 20 includes a tube body having an open end 25 and an end opposing the open end 25. The end opposing the open end 25, which defined a closed end 27, can be adapted to be closed prior to filling with product or contents to operate as a bottom for the bag 20 when the tube body is being filled through the open end 25 with contents. The tube body has a first wall 21 positioned between the open end 25 and the closed end 27, and a second wall 37 positioned to face opposite the first wall 21 between the open and the closed end 25, 27. The open end 25 can also be adapted to be selectively positioned between an open bag position and a closed bag position by a user. The bag 20 also preferably includes a reclosable sealer 22. The reclosable sealer 22 is connected to and extends outwardly from the first wall 21 of the tube body adjacent the open end 25. When the reclosable sealer 22 is in the open seal position a first portion 35 of the reclosable sealer 22 is separated from a second portion 45 of the reclosable sealer 22 and a user has access to contents of the bag 20. When the reclosable sealer 22 is in the closed seal position the first portion 35 of the reclosable sealer 22 contacts the second portion 45 of the reclosable sealer 22 and contents cannot be readily removed from the bag 20.

A bonding material 30 can be positioned on an outer surface of the reclosable sealer 22. As shown in FIG. 7, a disposable layer 51 is positioned to overly, abuttingly contact, and protect the bonding material 30 until the user desires to fill the bag. Then, once the user has filled the bag 20 with his or her own contents, the bag is folded so that the second wall 37 contacts bonding material 30 to create a permanent bond.

Figure 15:
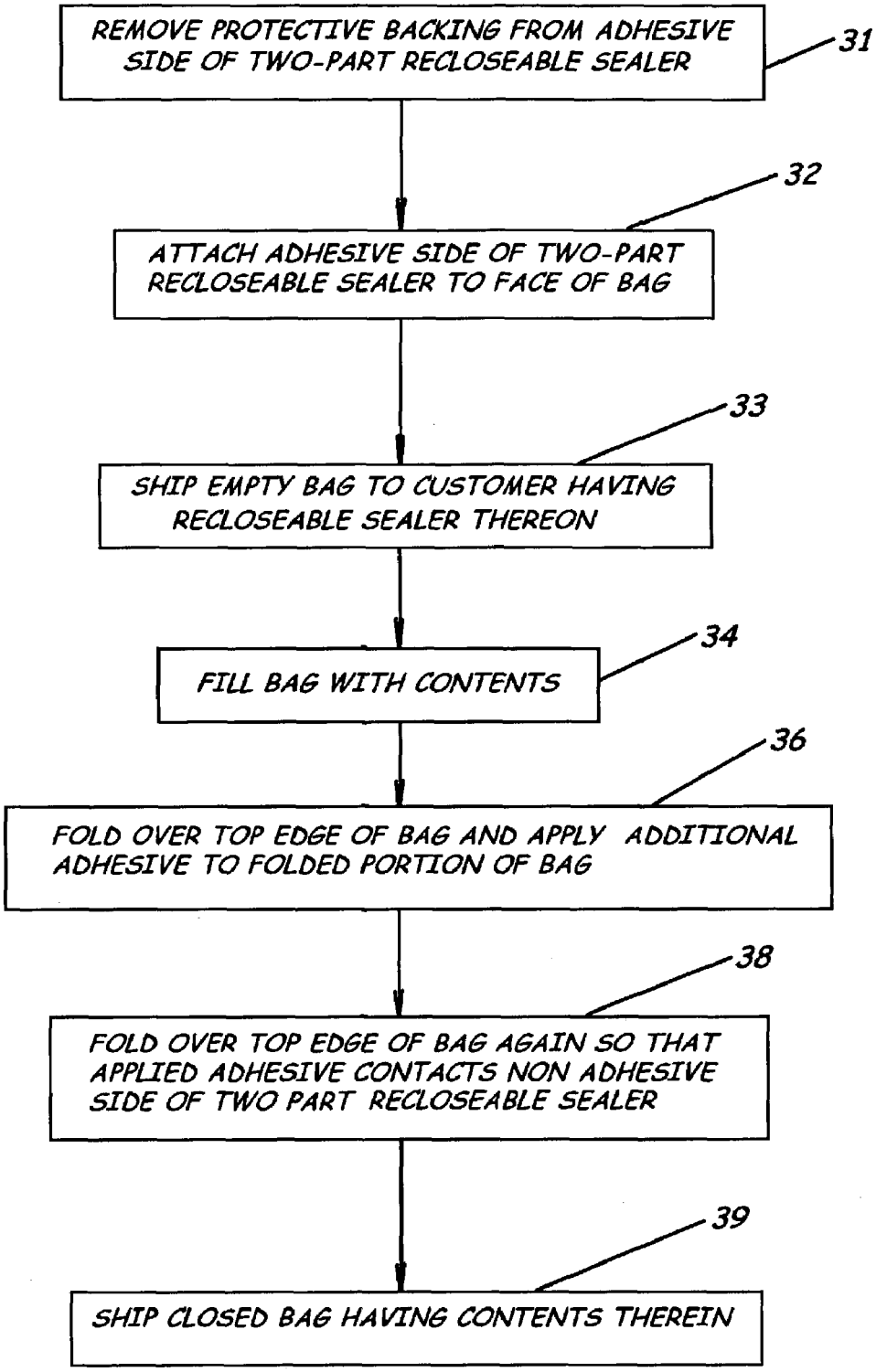
FIG. 15 is a flow diagram of a method of producing a bag having a reclosable sealer according to the present invention.

In addition to the bags with the reclosable sealers, the present invention also advantageously provides methods of forming and using a bag 20 having a reclosable sealer 22 associated therewith. A method of forming the bag 20 includes laminating a plurality of layers of material. The plurality of layers can include at least one of the following: a polymeric material, a metal foil material, and a paper material. Once the layers of material are laminated, the layers are formed into a tube body. The tube body preferably has an open end 25 and a closed end 27 positioned substantially opposite the open end 25. The tube body is formed from a plurality of laminated layers so that at least one layer of laminated material defines an inner surface of the tube body and at least one layer of laminated material defines an outer surface of the tube body. The tube body preferably has a first wall 21 positioned between the open end 25 and the closed end 27 and a second wall 37 positioned to face opposite the first wall 21. Once the tube body is formed, a reclosable sealer 22 is attached to the first wall 21 of the tube body adjacent the open end 25. As described in FIG. 15, a protective backing on an adhesive side of the reclosable sealer 22 is removed, then with the adhesive material being attached to a face of the bag (blocks 31 and 32). When the reclosable sealer 22 is in an open seal position a first portion 35 of the reclosable sealer 22 is separated from a second portion 45 of the reclosable sealer 22. When the reclosable sealer 22 is in the closed seal position the first portion 35 of the reclosable sealer 22 contacts the second portion 45 of the reclosable sealer 22 to thereby allow the bag 20 to be readily opened and closed. The bags 20 are shipped to customers having the reclosable sealer 22 thereon and then filled with an end user product (blocks 33 and 34). The bags 20 can preferably be shipped in a collapsed position to the customers for filling. No adhesive material is exposed to any product. This enables the reclosable sealer 22 to be attached securely to the bag 20 with little risk of contamination from filling material to come in contact with any of the attachment points. Once the bags are filled, a bonding material 30 is positioned on an outer surface of the second wall 37 of the tube body adjacent the open end 25 of the bag 20 (block 36). The first and second walls 21, 37 are folded until the bonding material 30 contacts and substantially adheres to the reclosable sealer 22 thereby forming a seal (block 38).

The bags 20 can have the bonding material 30 attached to an outside surface of the reclosable sealer 22 to enable users to easily attach the reclosable sealer 22 to the second wall 37 of the tube body. If the bonding material 30 is attached to the reclosable sealer 22, then a protective disposable layer 51 can be provided to keep product and crumbs out of the adhesive and to ensure that the adhesive securely attaches the reclosable sealer 22 to the second wall 37 of the tube body. Once the bags 20 are filled, the bags 20 can be shipped (block 39).

The method of forming the bag 20 with a reclosable sealer 22, for example, can be altered by supplying layers of materials that are already laminated according to the present invention. If the materials are already laminated, then the tube body can be formed without having to laminate the materials.

The reclosable sealer 22 can be attached to the second wall 37 of the tube body as described during the fold over or by various other application techniques. Examples of techniques for application to the first wall 21 can include blow-on, tamp-on, wipe-on, merge-on, flag, round product, and corner-wrap applications. Other application techniques will be known to those skilled in the art and are to be considered within the scope of the present invention.

As another embodiment of the present invention, the method of forming the bag 20 can be modified to include forming a bag 20 that consumers can purchase to fill with their own products. In this embodiment, the reclosable sealer is attached to the first wall 21 of the tube body adjacent the open end 25 and the bonding material 30 is positioned on an outer surface of the reclosable sealer 22. A disposable paper layer is positioned to overly, abuttingly contact, and protect the bonding material until the reclosable sealer 22 is attached to the second wall 37 of the tube body, as described herein.

Methods of using the bags 20 are also provided as additional embodiments of the present invention. In an embodiment, a second portion 45 of a reclosable sealer 22 is lifted to separate the second portion 45 of the reclosable sealer 22 from the first portion 35 of the reclosable sealer 22. Once the first and second portions 35, 45 are separated, the first wall 21 and the second wall 37 are unfolded and then separated. Once the walls 21, 37 are separated, users will have a wide access point to the contents of the bag 20. This wide access point will enable users to be able to perform such activities as scooping the contents out of the bag 20, as illustrated in FIG. 12.

Another method of using the bags 20 is also advantageously provided. In this embodiment, a first wall 21 and a second wall 37 of a bag 20 are separated to define an open bag position. The open bag position provides a substantially wide-opening access to contents of the bag 20, as shown in FIG. 7. The bag 20 advantageously has a reclosable sealer 22 attached to the first wall 21 adjacent an open end 25 so that when the reclosable sealer 22 is in an open seal position a first portion 35 of the reclosable sealer 22 is separated from a second portion 45 of the reclosable sealer 22. When the reclosable sealer 22 is in a closed seal position, the first portion 35 of the reclosable sealer 22 contacts the second portion 45 of the reclosable sealer 22 to thereby allow the bag 20 to be readily opened and closed. The bag 20 is then filled with contents through the substantially wide-opening access and into the bag 20 when in the open bag position. A protective disposable layer 51 that is positioned on a bonding material 30' positioned on an outer surface of the second portion 45 of the reclosable sealer 22 is removed once the bag 20 has been filled with contents. Once the bag 20 is filled, the first and second walls 21, 37 are folded until the bonding material 30' contacts and substantially bonds to the second wall 37 of the bag 20 thereby attaching the reclosable sealer 22 to the bag 20.

Yet another method of using a bag 20 is advantageously provided. In this embodiment, a first wall 21 and a second wall 37 of a bag 20 are separated to define an open bag position. The open bag position provides a substantially wide-opening access to contents of the bag 20. The bag 20 preferably has a reclosable scaler 22 attached to the first wall 21 adjacent an open end. When the reclosable sealer 22 is in an open seal position, a first portion 35 of the reclosable sealer 22 is separated from a second portion 45 of the reclosable sealer 22. When the reclosable sealer 22 is in a closed seal position, the first portion 35 of the reclosable sealer 22 contacts the second portion 45 of the reclosable sealer 22 to thereby allow the bag to be readily opened and closed. The bag 20 can be filled with contents through the substantially wide-opening access of the bag 20 when in the open bag position. Once the bag 20 is filled, a protective disposable layer 29 positioned on a bonding material 30 positioned on an outer surface of the second wall 37 is removed. The first and second walls 21, 37 are folded until the bonding material 30 contacts and substantially bonds to the second portion 45 of the reclosable sealer 22 thereby attaching the reclosable sealer 22 to the second wall 37.

For simplification of describing the invention herein, the bag 20 is described in terms of an open end 25, a closed end 27, a first wall 21, a second wall 37, and the like. These descriptions are merely illustrative of examples of a possible orientation of the bags of the present invention. Different orientations are possible and are to be considered within the scope of the present invention. For example, the references to the first wall 21 and the second wall 37 can be reversed as understood by those skilled in the art. As another example, the reclosable sealer 22 can be positioned on a second wall 37 of a bag 20 when the bag is in an initial open bag position, as illustrated, for example, in FIG. 9. As another example, an open end or an upper end generally refer to the top of the bag, and a closed end or a lower end generally refer to the bottom of the bag. Other variations will be known to those skilled in the art and are to be considered within the scope of the present invention.

Several advantages exist with the present invention. As a first advantage of the present invention, the reclosable sealer 22 of the bag 20 provides users with an indicator to determine if the bag 20 has already been open. This indication alerts consumers of possible tampering with the bag 20. As another advantage of the present invention, and particularly when the reclosable sealer 22 extends the entire length of the first wall 21 of the bag 20, the bag 20 is constructed in such a manner to prevent insects from being able to access the contents within the bag 20. The seal formed between the first portion of the reclosable sealer 22 and the second portion of the reclosable sealer 22 provides additional protection so that insects will not be able to gain access to the interior of the bag 20 once the reclosable sealer 22 is in a closed seal position. As yet another advantage, the second portion of the reclosable sealer 22 enables users to easily open and close bags without the use of extraneous items, such as scissors for opening the bags. The reclosable sealer allows users to seal the bag without the use of extraneous items, such as clips or bands.

From the foregoing it will be seen that the invention is well adapted to attain all of the ends and objects hereinabove set forth, together with other advantages that are obvious and that are inherent to the method and product. It will be understood that certain features and sub-combinations are of utility and may be employed without reference to other features and sub-combinations. This is contemplated by and is within the scope of the claims.

For example, various types of substrates with or without coatings can be used to form the tube body of the bag. Suitable substrates and coatings will be known to one skilled in the art. The use of the bag 20 with the reclosable sealer can be used for many types of consumer end products, such as candy, food items, or any type of packaging that needs a strong bag 20 with easy access to the contents of the bags.

Because many possible embodiments may be made of the invention without departing from the scope thereof, it is to be understood that all matter herein set forth or shown in the accompanying specification is to be interpreted as illustrative and not in a limiting sense. It should be apparent to those skilled in the art that the invention is susceptible to various changes without departing from the scope of the invention.

What claimed is:

1. A bag comprising:

a tube body having an open end, a closed end positioned substantially opposite the open end, a first wall positioned between the open end and the closed end, and a second wall positioned to face opposite the first wall between the open and the closed end, the open end being substantially wide when in an open bag position to allow ready filling of the bag with contents and to allow ready access to the contents when positioned in the bag and being positioned to be closed so that end portions of the second wall abuttingly contact end portions of the first wall when in a closed bag position; and a reclosable sealer having a first portion connected to the first wall of the tube body in a preselected region thereof and a second portion connected to and extending outwardly from the second wall of the tube body adjacent the open end so that when the first portion of the reclosable sealer is separated from the second portion the reclosable sealer is in an open seal position and when the first portion abuttingly contacts the second portion forming a seal the reclosable sealer is in a closed seal position, the bag having a bonding material connected to the second wall of the tube body and to the second portion of the reclosable sealer to bond the second portion of the reclosable sealer to the second wall, the first portion of the reclosable sealer having a first adhesive layer positioned to adhere the first portion of the reclosable sealer to the first wall of the tube body, a first film layer overlying and abuttingly contacting the first adhesive layer and a second adhesive layer overlying and contacting the first film layer and positioned to abuttingly contact a second portion of the reclosable sealer when in the closed seal position, the second portion having a second film layer positioned to abuttingly contact the second adhesive layer of the first portion of the reclosable sealer when in the closed seal position and a paper layer overlying and abuttingly contacting the second film layer, the paper layer substantially contacting and adhering to the bonding material positioned on the outer surface of the second wall of the tube body thereby forming a bond between the second portion of the reclosable sealer and the tube body.

2. A bag as defined in claim 1, wherein the second portion of the reclosable sealer has regions thereof extending toward the closed end of the tube body when in the closed seal position devoid of contact with the second adhesive layer of the first portion of the reclosable sealer to allow easy grasping by a user, and wherein the second portion of the reclosable sealer further comprises a release agent positioned on the second film layer between the second film layer of the second portion of the reclosable sealer and the second adhesive layer of the first portion of the reclosable sealer to enhance ready release of the second film layer of the second portion of the reclosable sealer from the second adhesive layer of the first portion of the reclosable sealer when an upright bag is in a closed seal position by manual upward pressure on the second portion.

3. A bag as defined in claim 1, wherein the first wall comprises a front wall having a first end and a second end, wherein the second wall comprises a back wall having a first end and a second end, wherein the respective first ends of the front and back walls define the open end of the tube body, wherein the respective second ends of the front and back walls define the closed end of the tube body, and wherein each of the first ends of the front and back walls is substantially linear and substantially perpendicular to side peripheries of the respective first and second walls.

4. A bag as defined in claim 1, wherein the end portions of the first and second walls are folded when in the closed bag position, wherein the second portion of the reclosable sealer comprises at least one of the following: a plastic material, a paper material, and a metal material, and wherein the reclosable sealer extends substantially the entire lateral extent of second wall of tube body adjacent the open end.

5. A bag as defined in claim 1, wherein peripheral portions of the bag further remain unsealed after initial opening of the reclosable sealer and when the reclosable sealer is in the closed seal position to thereby indicate that initial opening has occurred and indicate that tampering with the bag may have occurred.

6. A bag as defined in claim 1, further including perforations on peripheral portions of the second portion of the reclosable sealer and wherein the peripheral portions of the reclosable sealer further remain sealed and the perforation separates the peripheral portions of the second portion of the reclosable sealer from a remaining portion of the second portion of the reclosable sealer after initial opening of the reclosable sealer and when the reclosable sealer is in the open seal position to thereby indicate that initial opening has occurred and indicate that tampering with the bag may have occurred.

7. A bag as defined in claim 1, wherein the tube body includes a plurality of layers of laminated material comprising at least one of the following: a polymeric material, a metal foil material, and a paper material.

8. A bag as defined in claim 1, wherein the second adhesive layer of the first portion comprises a continuous preselected pattern of adhesive material positioned in a preselected region of the outer surface of the first film layer of the first portion of the reclosable sealer.

9. A bag as defined in claim 8, wherein the continuous preselected pattern comprises a plurality of spaced apart lines of adhesive material positioned on the outer surface of the first film layer in the preselected region.

10. A bag as defined in claim 1, wherein the first portion of the reclosable sealer comprises a first bag flange member and the second portion of the reclosable sealer comprises a second bag flange member, the second portion of the reclosable sealer overlies and substantially contacts the first portion of the reclosable sealer when in the closed seal position.

11. A bag comprising:

a tube body having an open end, a closed end positioned substantially opposite the open end, a first wall positioned between the open end and the closed end, and a second wall positioned to face opposite the first wall between the open and the closed end; and a reclosable sealer having a first portion connected to the first wall of the tube body in a preselected region thereof and a second portion connected to and extending outwardly from the second wall of the tube body adjacent the open end so that when the first portion of the reclosable sealer is separated from the second portion the reclosable sealer is in an open seal position and when the first portion of the reclosable sealer abuttingly contacts the second portion of the reclosable sealer forming a seal the reclosable sealer is in a closed seal position, the bag having a bonding material connected to the second wall of the tube body and to the second portion of the reclosable sealer to bond the second portion of the reclosable sealer to the second wall, the first portion of the reclosable sealer having a first adhesive layer positioned to adhere the first portion of the reclosable sealer to the first wall of the tube body, a first film layer overlying and abuttingly contacting the first adhesive layer and a second adhesive layer overlying and contacting the first film layer and positioned to abuttingly contact the second portion of the reclosable sealer when in the closed seal position, the second portion of the reclosable sealer having a second film layer positioned to abuttingly contact the second adhesive layer of the first portion of the reclosable sealer when in the closed seal position and a paper layer overlying and abuttingly contacting the second film layer, the paper layer substantially contacting and adhering to the bonding material positioned on the outer surface of the second wall of the tube body thereby forming a bond between the reclosable sealer and the tube body, the reclosable sealer has regions thereof extending toward the closed end of the tube body when in the closed seal position devoid of contact with the second adhesive layer of the first portion of the reclosable sealer for easy grasping by a user, the second portion of the reclosable sealer having a release agent positioned on the second film layer to enhance ready release of the second portion of the reclosable sealer from the second adhesive layer of the first portion of the reclosable sealer when an upright bag is in a closed seal position by manual upward pressure on the second portion.

12. A bag as defined in claim 11, wherein the first wall has a first end and a second end, wherein the second wall has a first end and a second end, wherein the respective first ends of the first and second walls define the open end of the tube body, wherein the respective second ends of the first and second walls define the closed end of the tube body, wherein each of the first ends of the first and second walls is substantially linear and substantially perpendicular to side peripheries of the respective first and second walls, and wherein the open end being substantially wide when in an open bag position to allow ready filling of the bag with contents and to allow ready access to the contents when positioned in the bag.

13. A bag as defined in claim 11, wherein the end portions of the first and second walls are folded when in the closed bag position, wherein the second portion of the reclosable sealer comprises a plastic material, and wherein the reclosable sealer extends substantially the entire lateral extent of second wall of tube body adjacent the open end.

14. A bag as defined in claim 11, wherein peripheral portions of the bag further remain unsealed after initial opening of the reclosable sealer and when the reclosable sealer is in the closed seal position to thereby indicate that initial opening has occurred and indicate that tampering with the bag may have occurred.

15. A bag as defined in claim 11, further including perforations on peripheral portions of the second portion of the reclosable sealer and wherein the peripheral portions of the reclosable sealer further remain sealed and the perforation separates the peripheral portions of the second portion of the reclosable sealer from a remaining portion of the second portion of the reclosable sealer after initial opening of the reclosable sealer and when the reclosable sealer is in the open seal position to thereby indicate that initial opening has occurred and indicate that tampering with the bag may have occurred.

16. A bag as defined in claim 11, wherein the tube body includes a plurality of layers of laminated material comprising at least one of the following: a polymeric material, a metal foil material, and a paper material.

17. A bag as defined in claim 11, wherein the second adhesive layer of the first portion comprises a continuous preselected pattern of adhesive material positioned in a preselected region of the outer surface of the first film layer of the first portion of the reclosable sealer.

18. A bag as defined in claim 17, wherein the continuous preselected pattern comprises a plurality of spaced apart lines of adhesive material positioned on the outer surface of the first film layer in the preselected region.

19. A bag as defined in claim 11, wherein the first portion of the reclosable sealer comprises a first bag flange member and the second portion of the reclosable sealer comprises a second bag flange member, the second portion of the reclosable sealer overlies and substantially contacts the first portion of the reclosable sealer when in the closed seal position.

* * * * *